US006572343B2

(12) United States Patent
Yokomachi et al.

(10) Patent No.: US 6,572,343 B2
(45) Date of Patent: Jun. 3, 2003

(54) CYLINDER BLOCK FOR A PISTON-TYPE COMPRESSOR WITH DEFORMATION ABSORBING GAPS

(75) Inventors: Naoya Yokomachi, Kariya (JP); Tatsuya Koide, Kariya (JP); Masakazu Murase, Kariya (JP); Yoshio Taneda, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 67 days.

(21) Appl. No.: 09/955,532

(22) Filed: Sep. 18, 2001

(65) Prior Publication Data

US 2002/0041811 A1 Apr. 11, 2002

(30) Foreign Application Priority Data

Oct. 5, 2000 (JP) ..... 2000-306182

(51) Int. Cl.[7] ..... F04B 27/08
(52) U.S. Cl. ..... 417/269; 92/71
(58) Field of Search ..... 417/269, 571; 92/71; 62/217; 184/6.16

(56) References Cited

U.S. PATENT DOCUMENTS 4,330,999 A * 5/1982 Nakayama ..... 62/217
5,052,898 A * 10/1991 Cook ..... 417/269
6,092,996 A 7/2000 Obrist et al. ..... 417/269
6,189,434 B1 2/2001 Kawaguchi et al. ..... 92/71
6,247,391 B1 * 6/2001 Murao et al. ..... 92/71
6,454,545 B1 * 2/2002 Ikeda et al. ..... 417/269
6,450,297 B1 * 9/2002 Kim ..... 184/6.16
2001/0028856 A1 * 10/2001 Ota et al. ..... 417/571

FOREIGN PATENT DOCUMENTS

JP 404058077 * 2/1992 ..... F04B/27/08
JP 407054770 * 2/1995 ..... F04B/27/08

* cited by examiner

*Primary Examiner*—Teresa Walberg
*Assistant Examiner*—Leonid M Fastovsky
(74) *Attorney, Agent, or Firm*—Woodcock Washburn LLP

(57) ABSTRACT

The deformation of cylinder bores in a cylinder block is prevented. The cylinder block 19 is inserted into a front housing 11. The cylinder block 19 is fixed to the front housing 11 by tightening plural screws 38 which penetrate through the cylinder block 19, from an end surface 191 side thereof, to be screwed into an end wall 32 of the front housing 11. Plural deformation absorbing grooves 39 are provided on the end surface 191. Each one of the deformation absorbing grooves 39 is provided in each intermediate space between the adjacent paired cylinder bores 41.

6 Claims, 9 Drawing Sheets

CYLINDER BLOCK FOR A PISTON-TYPE COMPRESSOR WITH DEFORMATION ABSORBING GAPS

BACKGROUND OF THE INVENTION

1. Field of the Invention

The present invention relates to a cylinder block for a piston type compressor in which plural cylinder bores are provided in the cylinder block and arranged around a rotating shaft, a piston is housed in each cylinder bore, then each of the pistons is reciprocated in the cylinder bore based on the rotation of the rotating shaft, and each piston causes refrigerant gas to be drawn into a compression chamber, which is defined in the cylinder bore and then discharged from the compression chamber.

2. Description of the Related Art

In a piston type compressor of a variable displacement type, as disclosed in Japanese Unexamined Patent Publication,(Kokai) No. 11-193780, a cylinder block that contains cylinder bores that guide pistons is assembled as a part of a housing assembly of the compressor and the housing assembly comprises a pair of housings (a front housing and a rear housing) and a cylinder block. The cylinder block is clamped by the pair of housings so as to constitute a part of an outer wall of the housing assembly. Plural bolts penetrate the front housing and the cylinder block and are screwed into the rear housing. The pair of housings and the cylinder block are assembled and fixed so as to constitute the housing assembly by tightening the bolts.

The cylinder bores housing the pistons in the cylinder block are arranged at approximately equal intervals around the axis of the rotating shaft and the bolts penetrate between the adjacent cylinder bores and are near the outer circumference of the cylinder block. The bolts penetrate through a crank chamber in the front housing and the end surface of a cylindrical circumferential wall of the front housing is coupled with the outer circumferential portion of an end surface of the cylinder block. In this structure, in which the front housing and the cylinder block are coupled to each other, the tightening force of the bolts causes the cylinder block to be deformed slightly and the cylindrical cylinder bores are then deformed. The deformation of the cylindrical cylinder bores prevents the pistons from moving smoothly. Besides, unnecessarily large clearances, between the circumferential surfaces of the pistons and the circumferential surfaces of the cylinder bores, are created, so that the refrigerant compressed in the cylinder bores leaks into the crank chamber through the clearances between the circumferential surfaces of the pistons and the circumferential surfaces of the cylinder bores. The excessive leakage of the refrigerant from the cylinder bores to the crank chamber disturbs the pressure in the crank chamber, which should be regulated, so that the displacement control in the compressor of a variable displacement type becomes unstable.

A piston type compressor in which a cylinder block is included in a housing assembly constituted by coupling a first housing to a second housing is disclosed, for example, in Japanese Unexamined Patent Publication (Kokai) No. 10-306773. The structure in which the cylinder block is included in the housing assembly prevents the coupling portions between the first housing and the cylinder block, and the coupling portions between the second housing and the cylinder block, from being exposed on the outside of the compressor. The hiding of the coupling portions is effective for reducing the possibility of leakage of refrigerant from the compressor.

The cylinder block is held, for example, by being interposed between the first housing and the second housing. In the piston type compressor in which the cylinder block is located inside the housings, the diameter of the cylinder block tends to be small. Therefore, in the structure in which the first housing comes into contact with the one end surface of the cylinder block and the second housing comes into contact with the other end surface of the cylinder block and then both of the housings are coupled by tightening bolts, a cylinder block with small diameter is easily deformed.

SUMMARY OF THE INVENTION

The object of the present invention is to prevent the cylinder bores in the cylinder block from being deformed.

Therefore, the present invention applies to a piston type compressor in which plural cylinder bores are provided in a cylinder block and arranged around a rotating shaft, a piston is housed in each cylinder bore, then each of the pistons is reciprocated in the cylinder bore based on the rotation of the rotating shaft, and the piston causes refrigerant gas to be drawn into a compression chamber which is defined in the cylinder bore and then discharged from the compression chamber. In the first aspect of the present invention, a deformation absorbing gap that absorbs the deformation of the cylinder block is provided, for at least a pair of the adjacent paired cylinder bores, between the adjacent paired cylinder bores.

The deformation of the cylinder bores due to the deformation of the cylinder block is avoided by the enlargement and the contraction of the deformation absorbing gaps.

The present invention may be more fully understood from the description of the preferred embodiments of the invention set forth below, together with the accompanying drawings.

DESCRIPTION OF THE PREFERRED EMBODIMENTS

The first embodiment, in which the present invention is embodied in a compressor of variable displacement type, is described with reference to FIG. 1 through FIG. 5. Carbon dioxide is used as refrigerant in the present invention.

Figure 1:
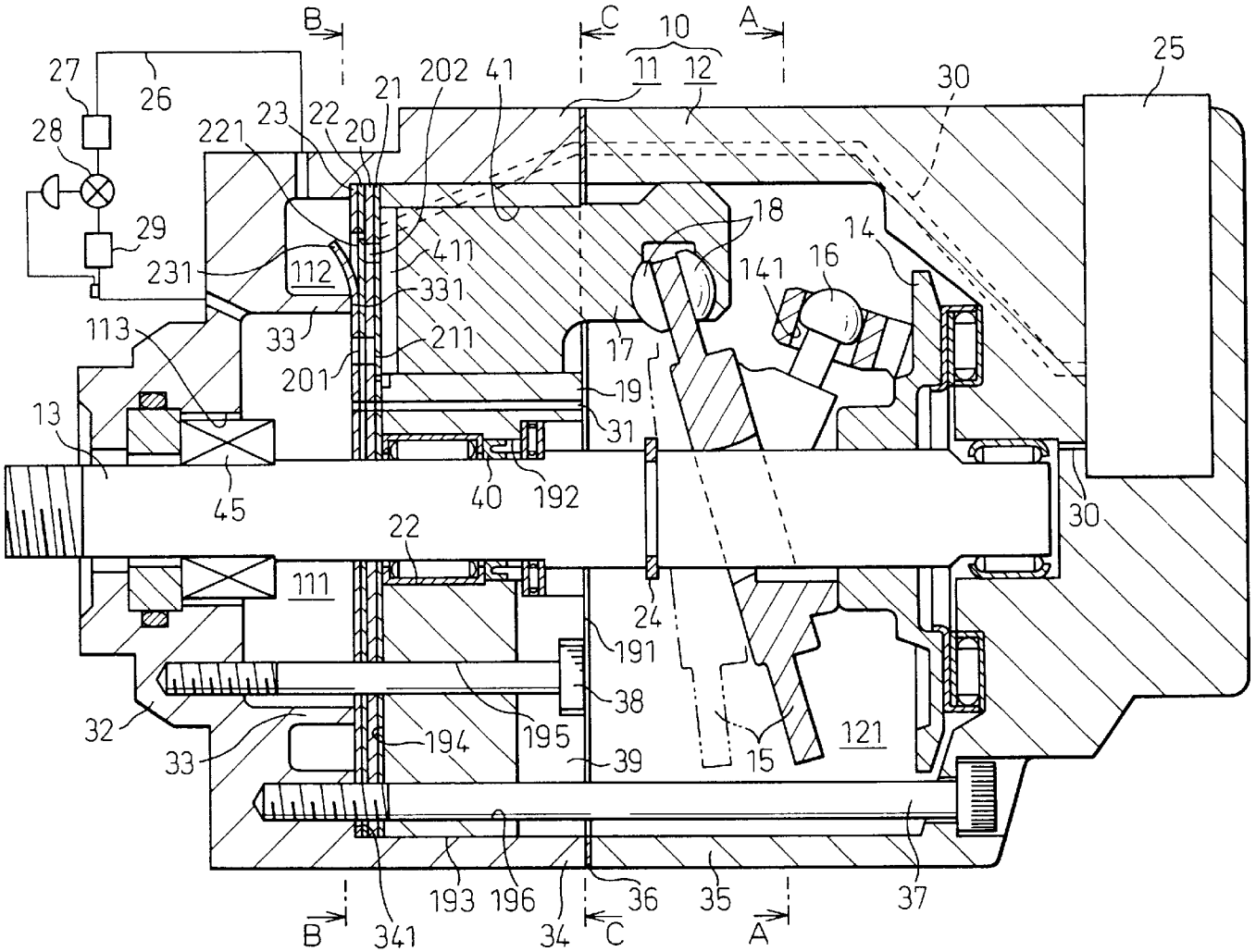
FIG. 1 is a profile cross-sectional view of the whole compressor in the first embodiment.

As shown in FIG. 1, the end surface of a circumferential wall 34 of a front housing 11 and the end surface of a circumferential wall 35 of a rear housing 12 are coupled to each other via a gasket 36. The front housing 11 that is a first housing and the rear housing 12 that is a second housing are fixed each other, by tightening plural bolts 37, to constitute a housing assembly 10.

A valve plate 20, valve forming plates 21 and 22, and a retainer forming plate 23 are inserted into the front housing 11, and a suction chamber 111 and a discharge chamber 112 are defined between the valve plate 20 and an end wall 32 of the front housing 11. The suction chamber 111 and the discharge chamber 112 are separated by the partition wall 33 and the suction chamber 111 is surrounded by the discharge chamber 112. A top surface 331 of the partition wall 33 comes into contact with the retainer forming plate 23 and the outer circumferential edge of the retainer forming plate 23 is jointed to a step 341 formed in the inner circumference of the circumferential wall 34 of the front housing 11.

Figure 3:
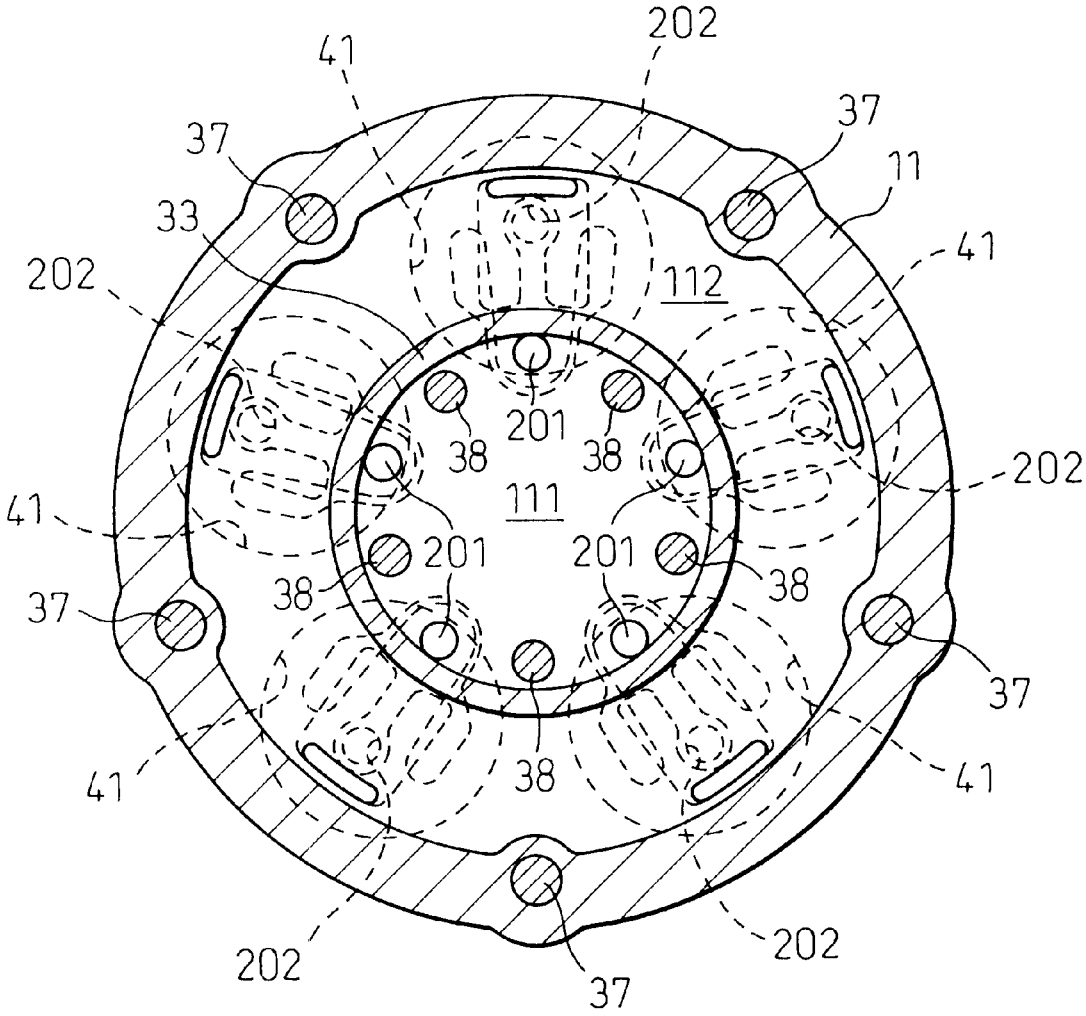
FIG. 3 is a section view taken along line B—B in FIG. 1.
Figure 4:
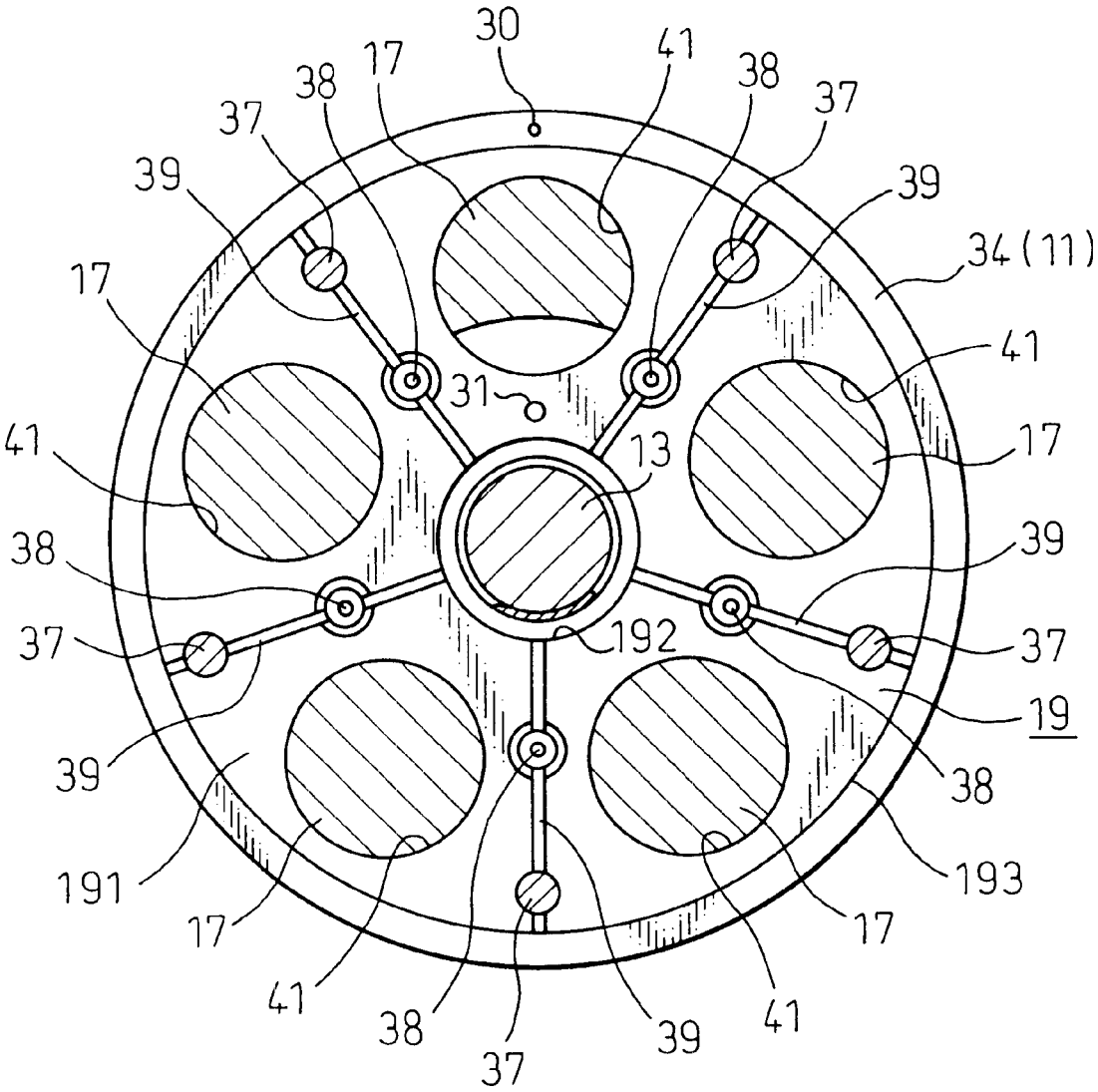
FIG. 4 is a section view taken along line C—C in FIG. 1.
Figure 5:
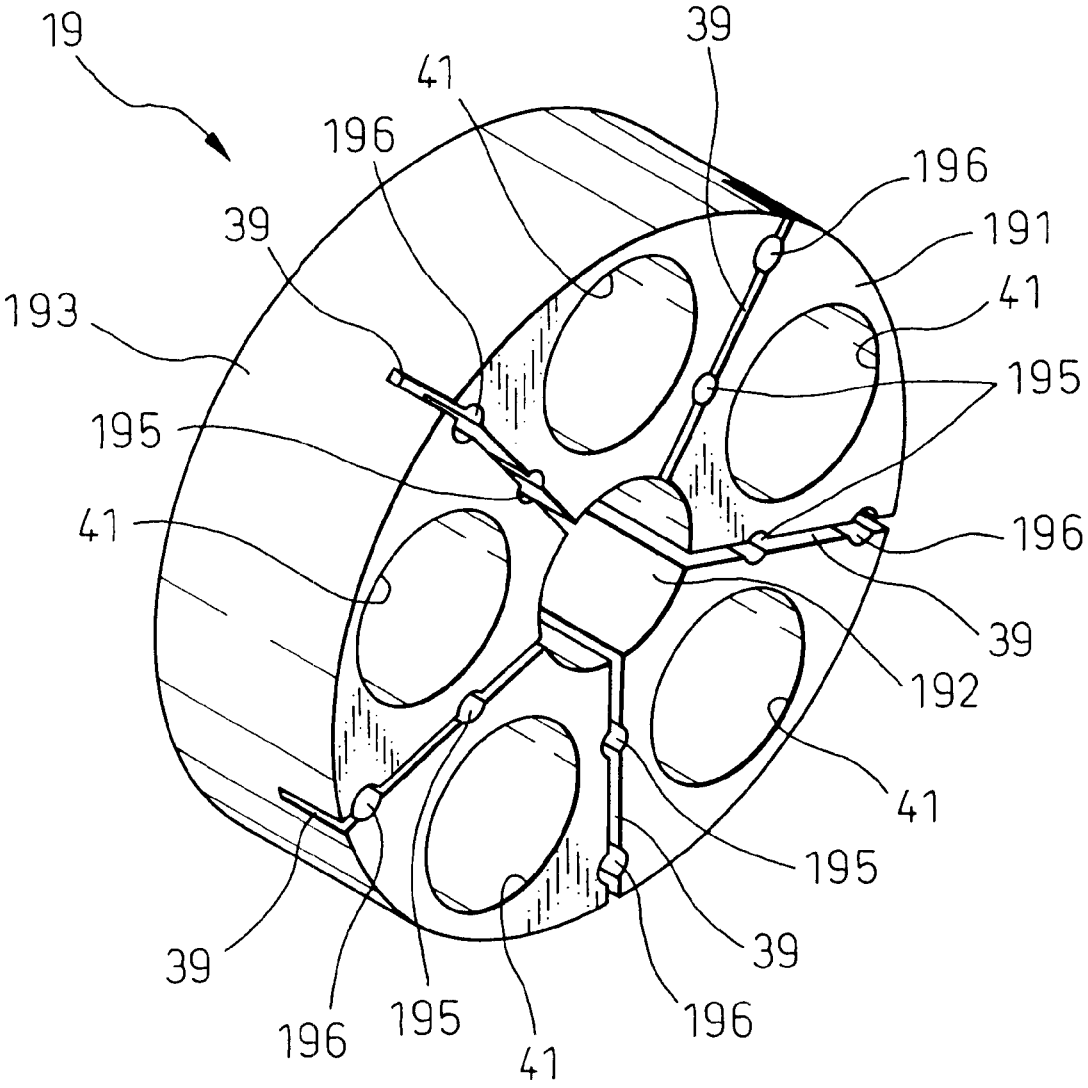
FIG. 5 is a perspective view of the cylinder block 19.

A cylinder block 19 is inserted in the front housing 11 so as to be jointed to the valve forming plate 21. The cylinder block 19 is fixed to the front housing 11 by tightening the plural screws 38 penetrating through the cylinder block 19 from the end surface 191 side of the cylinder block 19 so that the plural screws 38 are screwed into the end wall 32 of the front housing 11. Screw through-holes 195 and bolt through-holes 196 penetrate through the cylinder block 19 from the end surface 191 so as to reach an end surface 194. The plural cylinder bores 41 (only one is shown in FIG. 1, though there are five in this embodiment as shown in FIG. 3 through FIG. 5), are provided in the cylinder block 19. A screw through-hole 195 and a bolt through-hole 196 are provided in each space between the adjacent cylinder bores 41. The screws 38 penetrate through the screw through-holes 195 and also penetrate the suction chamber 111 surrounded by the partition wall 33. The bolts 37 penetrate through the bolt through-holes 196.

A rotating shaft 13 is supported, by the cylinder block 19 and the rear housing 12 that forms a control pressure chamber 121, so that the rotating shaft 13 can rotate. The rotation shaft 13 which passes through a shaft aperture 192 of the cylinder block 19 and a shaft aperture 113 of the front housing 11 to protrude outside the compressor receives a rotational drive force from an external power source (a vehicle engine, for example). A shaft sealing member 45, installed in the shaft aperture 113, prevents refrigerant from leaking from the suction chamber 111 to the outer side of the compressor along the circumferential surface of the rotating shaft 13. A shaft sealing member 40 installed in the shaft aperture 192 prevents refrigerant from leaking from the control pressure chamber 121 to the suction chamber 111 along the circumferential surface of the rotating shaft 13.

Figure 2:
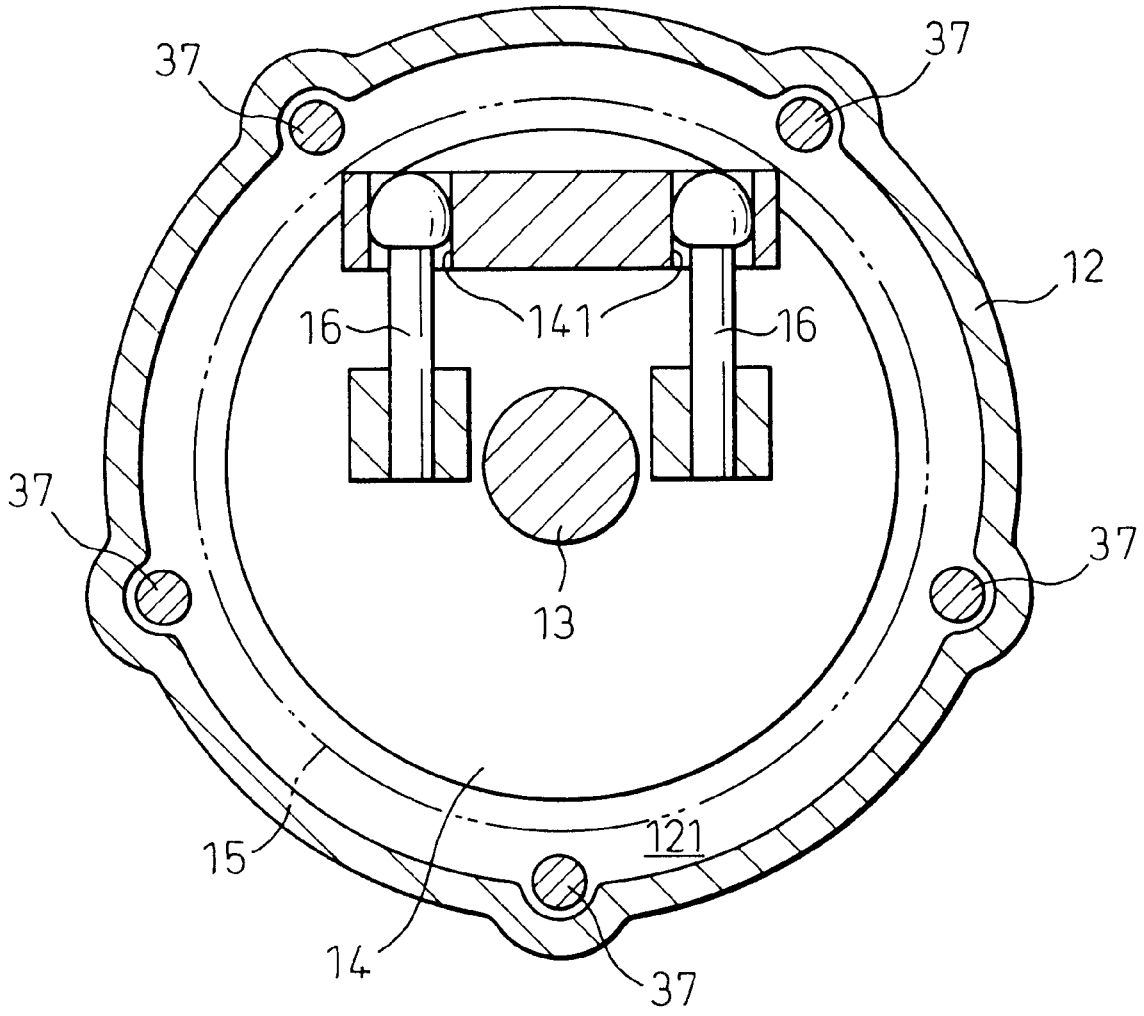
FIG. 2 is a section view taken along line A—A in FIG. 1.

Not only is a rotary support 14 fixed to the rotating shaft 13 but, also, a swash plate 15 is supported by the rotating shaft 13 so that the swash plate 15 can slide, move, and incline in the axial direction of the rotating shaft 13. As shown in FIG. 2, a pair of guide pins 16 is fixed to the swash plate 15. The guide pins 16 fixed to the swash plate 15 are slidably inserted into guide holes 141 formed on the rotary support 14. By engagement with the guide holes 141 and the guide pins 16, the swash plate 15 can move and incline in the axial direction of the rotating shaft 13 and rotate integrally with the rotating shaft 13. Inclination and movement of the swash plate 15 is guided by the relationship between the guide holes 141 and the guide pins 16, and the slide supporting action of the rotating shaft 13.

As shown in FIG. 1, a piston 17 is housed in each cylinder bore 41. The pistons 17 define compression chambers 411 in the cylinder bores 41. The rotational motion of the swash plate 15, which rotates integrally with the rotating shaft 13, is converted into a reciprocating motion of the piston 17 via shoes 18, and the pistons 17 move back and forth in the cylinder bores 41.

The refrigerant in the suction chamber 111, which is a suction pressure area, flows into the compression chamber 411, after pushing back a suction valve 211 on a valve forming plate 21, from a suction port 201 on a valve plate 20, due to the reversing motion (movement from left to right in FIG. 1) of the piston 17. The refrigerant that flows into the compression chamber 411 is discharged to the discharge chamber 112, which is a discharge pressure area, from a discharge port 202 on the valve plate 20, after pushing back a discharge valve 221 on a valve forming plate 22, due to the advancing motion (movement from right to left in FIG. 1) of the piston 17. The discharge valve 221 comes into contact with a retainer 231 on a retainer forming plate 23, resulting in a restriction on the opening of the discharge valve 221.

As shown in FIG. 4 and FIG. 5, plural deformation absorbing grooves 39 are formed on an end surface 191 which is located on the control pressure chamber 121 side and opposite to the compression chambers 411 in the cylinder block 19. The deformation absorbing grooves 39 are provided in intermediate spaces between adjacent cylinder bores 41 so as to cross the screw through-holes 195 and bolt through-holes 196. The deformation absorbing grooves 39 reach an outer circumferential surface 193 of the cylinder block 19 from the shaft aperture 192 in the radial direction. Moreover, the depth of the deformation absorbing grooves 39 is designed to be within a range in which the deformation absorbing grooves 39 do not reach the position of the shaft sealing member 40.

As shown in FIG. 1, a pressure supply passage 30, which connects the discharge chamber 112 and the control pressure chamber 121, passes the refrigerant in the discharge chamber 111 to the control pressure chamber 121. The refrigerant in the control pressure chamber 121 flows out into the suction chamber 111 through a pressure release passage 31 that connects the control pressure chamber 121 and the suction chamber 111. An electromagnetic displacement control valve 25 is interposed on the pressure supply passage 30. The displacement control valve 25 is controlled by a controller (not shown), which controls the energization and de-energization of the displacement control valve 25 based on the passenger compartment temperature detected by a passenger compartment temperature detector (not shown), which detects the passenger compartment temperature in a vehicle, and the target passenger compartment temperature set by a passenger compartment temperature adjuster (not shown).

The displacement control valve 25 is open when it is not energized with current, and it is closed when it is energized with current. That is, the refrigerant in the discharge chamber 112 is supplied to the control pressure chamber 121 when the displacement control valve 25 is de-energized and the refrigerant in the discharge chamber 112 is not supplied to the control pressure chamber 121 when the displacement control valve 25 is energized. The displacement control valve 25 controls the supply of the refrigerant from the discharge chamber 112 to the control pressure chamber 121.

The inclination angle of the swash plate 15 is changed based on the pressure control in the control pressure chamber 121. When the pressure in the control pressure chamber 121 increases, the inclination angle of the swash plate 15 decreases, and when the pressure in the control pressure chamber 121 decreases, the inclination angle of the swash plate 15 increases. When refrigerant is supplied from the discharge chamber 112 to the control pressure chamber 121, the pressure in the control pressure chamber 121 increases, and when the supply of refrigerant from the discharge chamber 112 to the control pressure chamber 121 is terminated, the pressure in the control pressure chamber 121 decreases. That is, the inclination angle of the swash plate 15 is controlled by the displacement control valve 25.

The maximum inclination angle of the swash plate 15 is defined when the swash plate 15 comes into contact with the rotary support 14. The minimum inclination angle of the swash plate 15 is defined when a circlip 24 on the rotating shaft 13 comes into contact with the swash plate 15.

The discharge chamber 112 and the suction chamber 111 are connected via an external refrigerant circuit 26. The refrigerant, which flows out from the discharge chamber 112 into the external refrigerant circuit 26, is fed back to the suction chamber 111 via a condenser 27, an expansion valve 28, and an evaporator 29.

The following effects can be obtained in the first embodiment.

(1-1)

The cylinder block 19 which is fixed to the front housing 11 by tightening the plural screws 38 is deformed by the tightening force of the screws 38. The tightening force of the screws 38 is received by a partition wall 33 and the step 341 of the front housing 11 and the screws 38 pass through the suction chamber 111, that is, the inside of the annular partition wall 33. Thus, the tightening force of the screws 38 causes the cylinder block 19 to be deformed so that the end surface 191 of the cylinder block 19 is concaved. Such deformation causes the diameter of the cylinder block 19 at the end surface 191 side to be reduced so as to cause the circular shape of the cylinder bores 41 to be deformed.

If all the spaces between the adjacent cylinder bores 41 are filled with solid portions which form the cylinder block 19, the cylinder block 19 deforms intensively around the periphery of the cylinder bores 41, so that the circular shape of the cylinder bores 41 is deformed greatly.

However, if the deformation absorbing grooves 39 are provided in the solid portions between the adjacent cylinder bores 41, when the cylinder block 19 is deformed by the tightening force of the screws 38, the ends of the solid portions, facing each other, approach each other in situation in which the deformation absorbing grooves 39 are made to be boundaries. Moreover, as described above, as the tightening force of the screws 38 causes the cylinder block 19 to be deformed so that the end surface 191 of the cylinder block 19 is concaved, the adjacent cylinder bores 41 are moved toward the center of the cylinder block 19 in radial direction and approach each other in circumferential direction. Therefore, the deformation of the circular shape of the cylinder bores 41 is prevented. In other words, the deformation of the cylinder bores 41 due to the deformation of the cylinder block 19 is prevented by reducing the width of the deformation absorbing grooves 39.

(1-2)

The deformation absorbing groove 39, which is designed as an embodiment of the deformation absorbing gap, is provided in each of all solid portions between the adjacent cylinder bores 41. Therefore, due to the tightening force of the screws 38, all the paired facing ends of solid portions around the cylinder bores 41 approach each other at equal distance and because the end surface 191 of the cylinder block 19 is concaved, the adjacent cylinder bores 41 are equally moved toward the center of the cylinder block 19 in radial direction and equally approach each other in circumferential direction, so that the deformations of all the cylinder bores 41 are equally reduced.

(1-3)

The deformation absorbing grooves 39 can be produced with the cylinder block 19 while molding the cylinder block 19, or can be produced by cutting after molding the cylinder block 19. In both cases, the production of the deformation absorbing grooves 39 is easy and the deformation absorbing grooves 39 which are provided on the end surface 191 of the cylinder block 19 are simple and convenient as an embodiment of the deformation absorbing gaps.

(1-4)

The deformation absorbing grooves 39 are provided on the end surface 191 side of the cylinder block 19, exposed to the control pressure chamber 121. The bottoms of the deformation absorbing grooves 39 are prevented from reaching the location positions of the compression chamber 411 and the shaft sealing member 40, so that the control pressure chamber 121 cannot communicate with the compression chamber 411 and the suction chamber 111 through the deformation absorbing grooves 39. Such structure in which the deformation absorbing grooves 39 are provided on the end surface 191, which is located on the control pressure chamber 121 side and opposite to the compression chamber 411, is simple and convenient for preventing the deformation absorbing grooves 39 from reaching the location position of the compression chamber 411 and the shaft sealing member 40. Therefore, the end surface 191 opposite to the compression chamber 411 is optimal as the forming position of the deformation absorbing grooves 39.

(1-5)

The deformation absorbing grooves 39 having a length from the shaft aperture 192 of the cylinder block 19 to the outer circumferential surface 193 are preferable for preventing the deformation of the cylinder bores 41 due to the deformation of the cylinder block 19.

(1-6)

The cylinder block 19 included in the housing assembly 10 is generally smaller than that exposed on the outside of a compressor. The smaller the cylinder block is, the easier the cylinder bores are deformed. The present invention is specially effective for applying to a piston type compressor including a small cylinder block 19.

(1-7)

The operating pressure of carbon dioxide refrigerant is higher than that of the chlorofluorocarbon type refrigerant. The increase of the operation pressure of the refrigerant makes the refrigeration more efficient, so that the size of a compressor can be reduced by reducing the volume of the cylinder bores 41. That is, the size of the cylinder block 19 in a compressor, which uses carbon dioxide refrigerant, can be reduced in comparison with that of the cylinder block in a compressor, which uses chlorofluorocarbon type refrigerant. Therefore, the present invention is specially effective for the application to the piston type compressor using carbon dioxide refrigerant.

Figure 6:
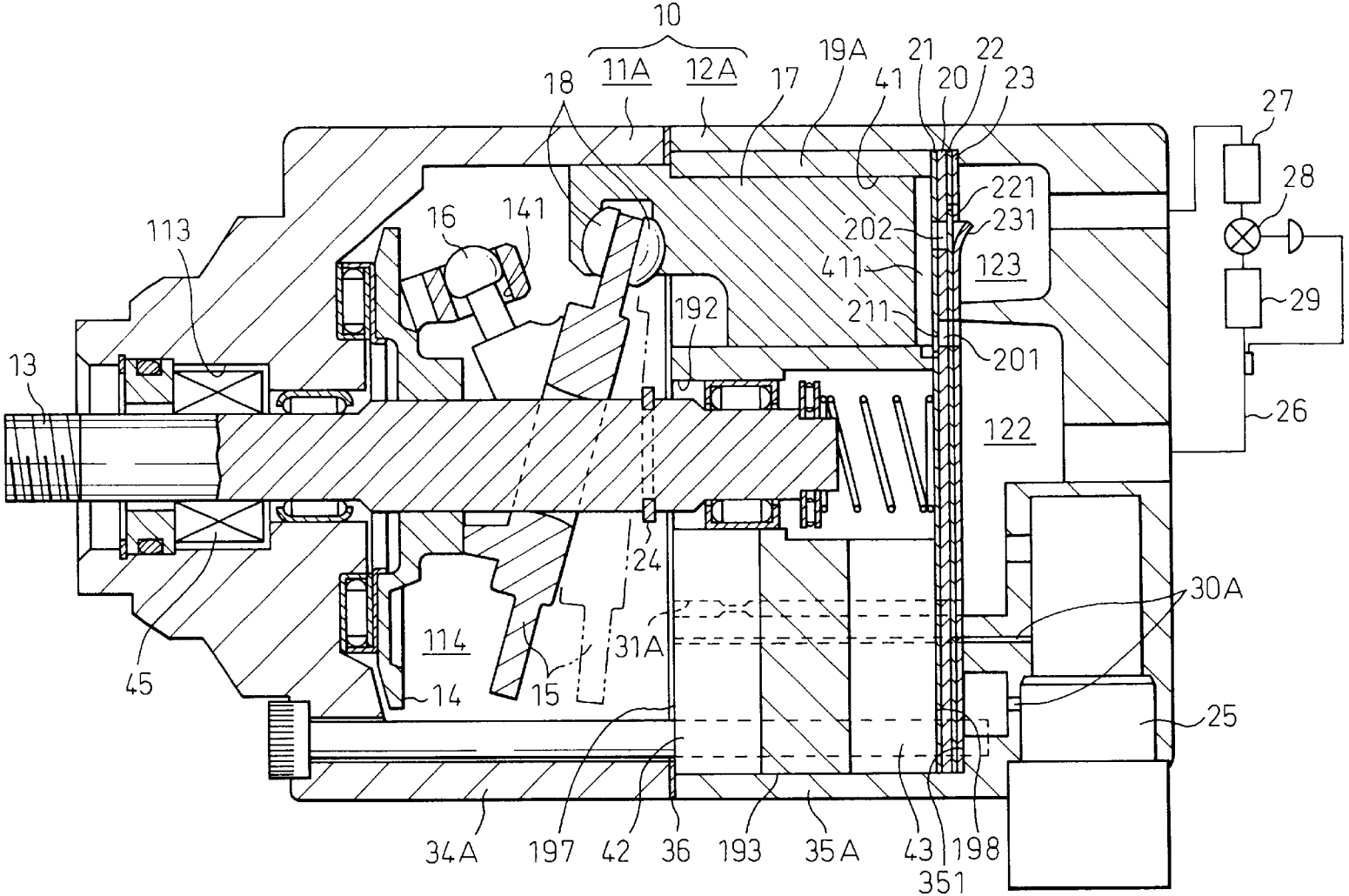
FIG. 6 is a profile cross-sectional view of the whole compressor in the second embodiment.
Figure 7:
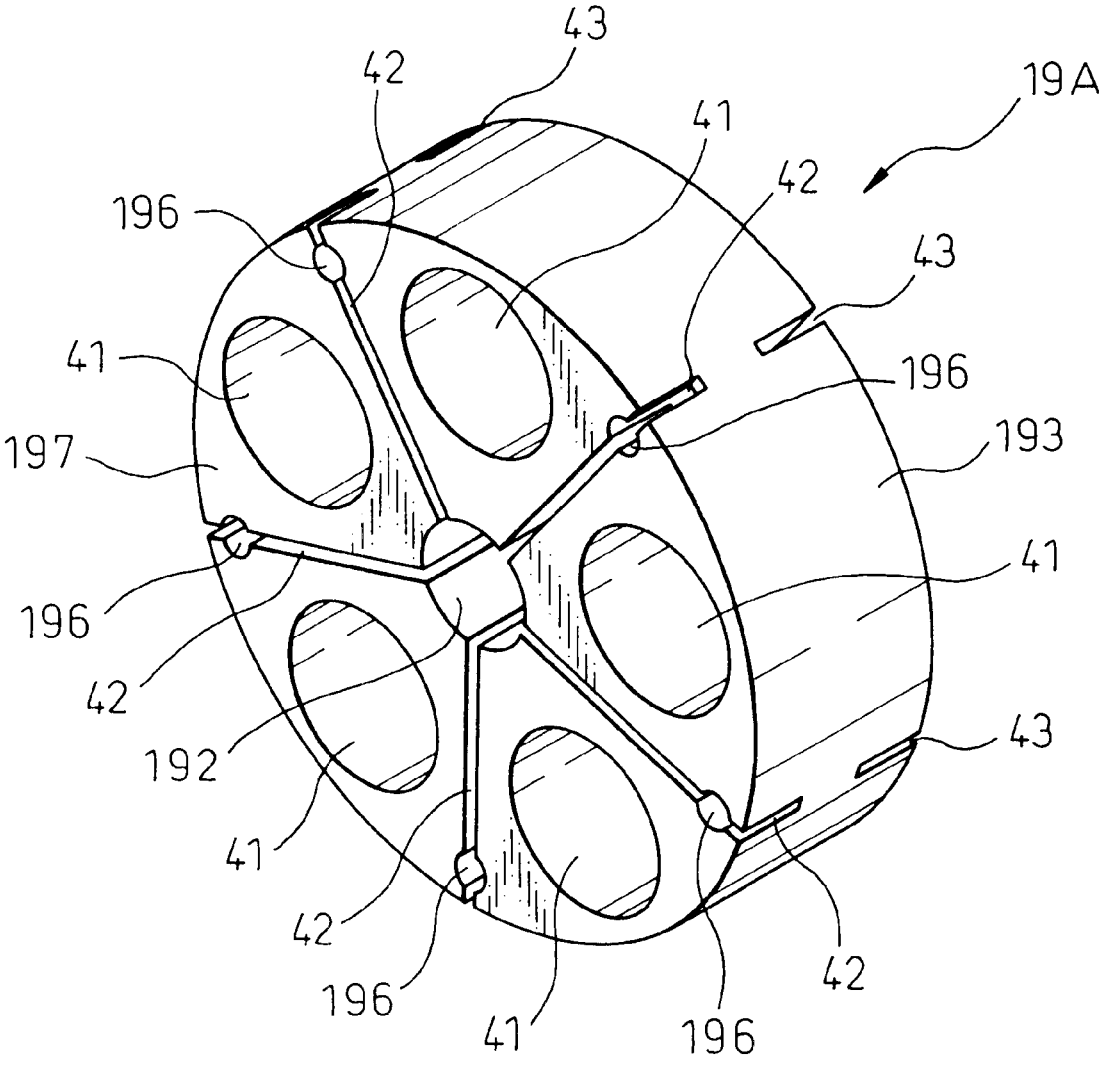
FIG. 7 is a perspective view of the cylinder block 19A.

Next, the second embodiment in FIG. 6 and FIG. 7 is described. The same symbols are attached to the same components as in the first embodiment.

In this embodiment, a suction chamber 122 and a discharge chamber 123 are provided at a rear housing 12A side, and the valve plate 20, the valve forming plates 21 and 22, the retainer forming plate 23 and a cylinder block 19A are inserted into the rear housing 12A. The cylinder block 19A is pressed and inserted into the rear housing 12A. A step 351 provided in the inner circumference side of a circumferential wall 35A of the rear housing 12A determines the position of the cylinder block 19A with respect to the rear housing 12A.

A control pressure chamber 114 is provided in a circumferential wall 34A of a front housing 11A and the rotating shaft 13 is supported by the cylinder block 19A and the front housing 11A so as to be able to rotate. A pressure supply passage which connects the discharge chamber 123 and the control pressure chamber 114 is indicated by 30A and a pressure release passage which connects the control pressure chamber 114 and the suction chamber 122 is indicated by 31A.

Deformation absorbing grooves 42 and 43 are formed on the end surfaces 197 and 198 of the cylinder block 19A. The cylinder block 19A pressed and inserted into the rear housing 12A is deformed by the reaction force of press insertion so that the diameter thereof is reduced, while the deformation absorbing grooves 42 and 43 prevent the cylinder bores 41 from being deformed as much as in the case of the first embodiment of the present invention. The deformation absorbing grooves 42 prevent the circular shape of the cylinder bores 41 at the end surface 197 side from being deformed and the deformation absorbing grooves 43 prevent the circular shape of the cylinder bores 41 at the end surface 198 side from being deformed.

Figure 8:
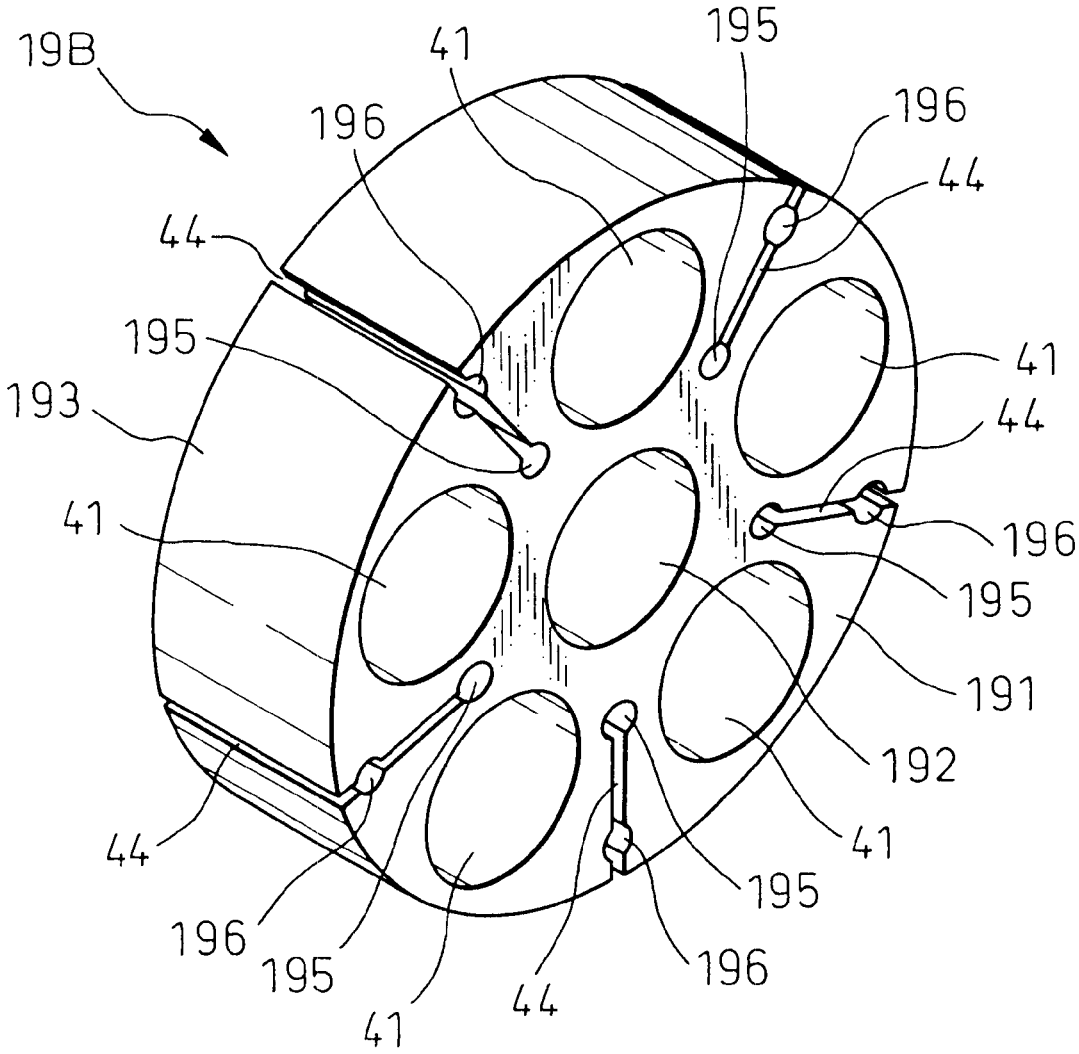
FIG. 8 is a perspective view of the third embodiment.

Next, the third embodiment in FIG. 8 is described. The same symbols are attached to the same components as in the first embodiment.

A cylinder block 19B is inserted into the front housing 11 (not shown). Deformation absorbing grooves 44 are provided in the outer circumferential surface 193 of the cylinder block 19B so as to partition the adjacent cylinder bores 41. The deformation absorbing grooves 44 extend from the one end surface 191 of the cylinder block 19B to the other end surface 194 (not shown) thereof. The deformation absorbing grooves 44 prevent the circular shape of the cylinder bores 41 from being deformed along the whole length of the cylinder bores 41.

Figure 9A:
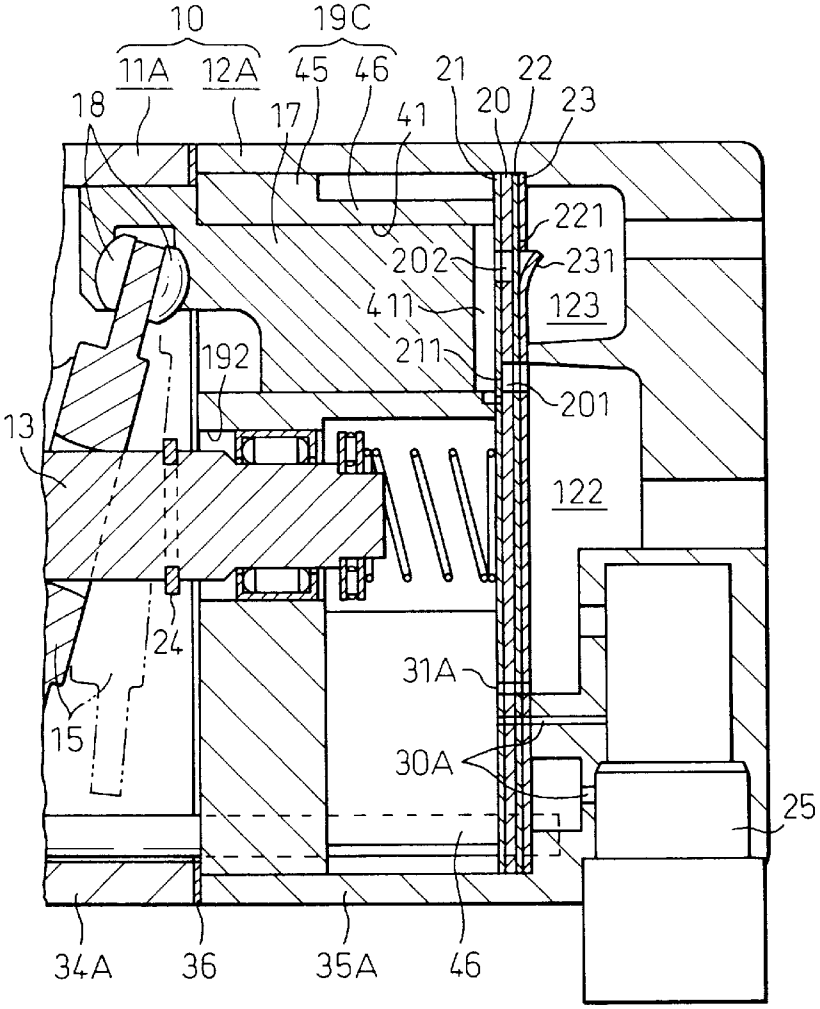
FIG. 9A is a profile cross-sectional view of the major components of the fourth embodiment.
Figure 9B:
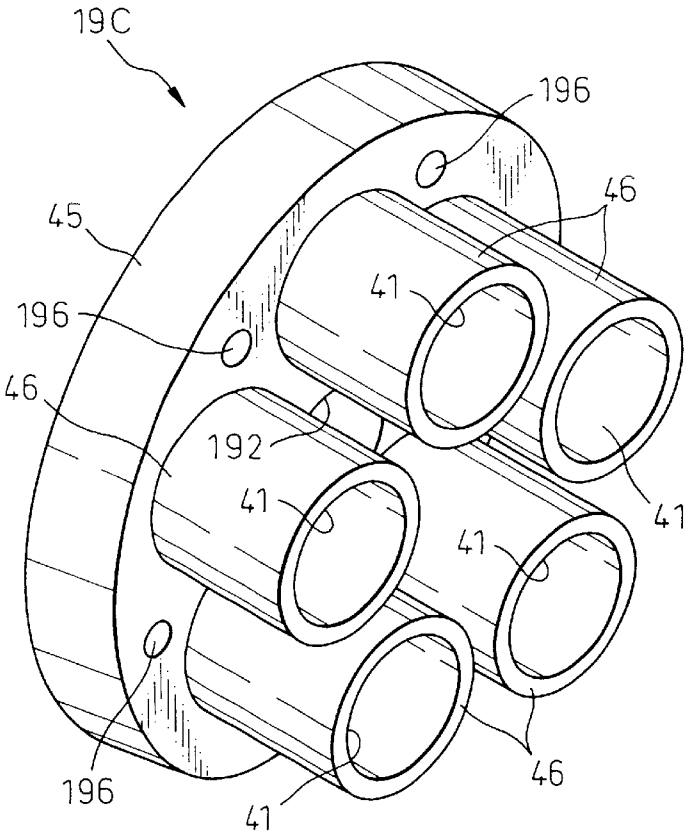
FIG. 9B is a perspective view of the cylinder block 19C of the fourth embodiment.

Next, the fourth embodiment in FIG. 9A and FIG. 9B is described. The same symbols are attached to the same components as in the second embodiment.

A cylinder block 19C comprises a base plate portion 45 for supporting the rotating shaft 13 and plural bore forming protrusions 46 installed on the base plate portion 45. The cylinder bores 41 are formed in the base plate portion 45 and the bore forming protrusions 46 so as to penetrate therethrough and a shaft aperture 192 is formed in the base plate portion 45.

As shown in FIG. 9B, plural bore forming protrusions 46 are spaced apart each other and the gaps between the respective bore forming protrusions 46 prevent the circular shape of the cylinder bores 41 from being deformed.

In the present invention, the following embodiments may be realized.

(1) The number of the deformation absorbing gaps is reduced so that the number of the deformation absorbing gaps is less than that of pairs of the adjacent paired cylinder bores.

(2) Plural pieces of cylinder block pieces are assembled to construct a cylinder block and to provide gaps between adjacent connecting portions of the respective cylinder block pieces so that the gaps act as the deformation absorbing gaps.

(3) The present invention is applied to a piston type compressor in which a cylinder block forms a part of an outer wall of a housing assembly, as disclosed in Japanese Unexamined Patent Publication (Kokai) No. 11-193780.

In this case, it is necessary to prevent the deformation absorbing gaps from being exposed on the outside of the housing assembly.

(4) The present invention is applied to a piston type compressor of a fixed displacement type.

(5) The present invention is applied to a piston type compressor in which chlorofluorocarbon type refrigerant is used.

As described above, the present invention, in which the deformation absorbing gap for absorbing the deformation of the cylinder block is provided between at least a pair of the adjacent paired cylinder bores, can be expected to bring an excellent effect in that the deformation of the cylinder bores can be prevented in the cylinder block.

While the invention has been described by reference to specific embodiments chosen for the purposes of illustration, it should be apparent that numerous modifications could be made thereto by those skilled in the art without departing from the basic concept and scope of the invention.

What is claimed is:

1. A cylinder block in a piston type compressor:

wherein plural cylinder bores are provided in the cylinder block and arranged around a rotating shaft, a piston is housed in each cylinder bore, the respective pistons are reciprocated in the cylinder bores based on the rotation of the rotating shaft, and the pistons cause refrigerant gas to be drawn into compression chambers which are defined in the cylinder bores and then discharged from the compression chambers; and wherein a deformation absorbing gap for absorbing the deformation of the cylinder block is provided between at least a pair of the adjacent paired cylinder bores.

2. A cylinder block in a piston type compressor, as set forth in claim 1, wherein the deformation absorbing gaps are provided in all the spaces between the adjacent paired cylinder bores.

3. A cylinder block in a piston type compressor, as set forth in claim 1, wherein the deformation absorbing gaps are deformation absorbing grooves formed on an end surface of the cylinder block so that the deformation absorbing grooves are provided along the radial direction of the cylinder block.

4. A cylinder block in a piston type compressor, as set forth in claim 3, wherein the end surface of the cylinder block is opposite to the compression chambers side.

5. A cylinder block in a piston type compressor, as set forth in claim 3, wherein the deformation absorbing grooves reach an outer circumferential surface of the cylinder block from a shaft aperture which is penetrated by the rotating shaft in the cylinder block.

6. A cylinder block in a piston type compressor, as set forth in claim 1, wherein the cylinder block is included in an inner side of a housing assembly constituted by coupling a first housing to a second housing.

* * * * *